US005189742A

United States Patent [19]

Schild

[11] Patent Number: 5,189,742

[45] Date of Patent: Mar. 2, 1993

[54] PRESSURE CONTROLLED INFLATABLE PAD APPARATUS

[75] Inventor: Rolf Schild, London, United Kingdom

[73] Assignee: Canon Kabushiki Kaisha, Tokyo, Japan

[21] Appl. No.: 854,833

[22] Filed: Mar. 20, 1992

[30] Foreign Application Priority Data

Mar. 9, 1992 [GB] United Kingdom ..... 9205075

[51] Int. Cl.[5] ..... A47C 27/08

[52] U.S. Cl. ..... 5/453; 5/455; 5/914; 5/456

[58] Field of Search ..... 5/453, 455, 456, 914

[56] References Cited

U.S. PATENT DOCUMENTS

| | | | |
|---|---|---|---|
| 3,297,023 | 1/1967 | Foley | 128/33 |
| 3,462,778 | 8/1969 | Whitney | 5/455 |
| 3,727,606 | 4/1973 | Sielaff | 128/2 S |
| 3,909,858 | 10/1975 | Ducker | 5/348 R |
| 3,919,730 | 11/1975 | Regan | 5/348 R |
| 4,005,236 | 1/1977 | Graebe | 428/72 |
| 4,175,297 | 11/1979 | Robbins et al. | 5/284 |
| 4,193,149 | 3/1980 | Welch | 5/447 |
| 4,197,837 | 4/1980 | Tringali et al. | 128/33 |
| 4,320,766 | 3/1982 | Alihanka et al. | 128/671 |
| 4,694,520 | 9/1987 | Paul et al. | 5/453 |
| 4,825,486 | 5/1989 | Kimura et al. | 5/453 |
| 4,873,737 | 10/1989 | Savenije | 5/453 |
| 5,035,016 | 7/1991 | Mori et al. | 5/453 |
| 5,052,067 | 10/1991 | Thomas et al. | 5/455 |
| 5,117,518 | 6/1992 | Schild | 5/455 |

FOREIGN PATENT DOCUMENTS

| | | |
|---|---|---|
| 2385362 | 10/1978 | France . |
| WO8908438 | 9/1989 | PCT Int'l Appl. . |
| 0796746 | 6/1958 | United Kingdom . |
| 1118740 | 7/1968 | United Kingdom . |
| 1465261 | 2/1977 | United Kingdom . |
| 2183471 | 6/1987 | United Kingdom . |

*Primary Examiner*—Renee S. Luebke
*Assistant Examiner*—Michael I. Milano
*Attorney, Agent, or Firm*—Fitzpatrick, Cella, Harper & Scinto

[57] ABSTRACT

A pressure controlled inflatable pad for supporting the body of a patient including a source of inflating fluid which provides a flow of fluid to inflate the pad through a fluid supply line. As the fluid flows through the fluid supply line, it passes through a sensor located beneath the pad to reduce fluid flow to an exhaust if the pad is insufficiently inflated to support the patient's body.

22 Claims, 3 Drawing Sheets

PRESSURE CONTROLLED INFLATABLE PAD APPARATUS

The present invention relates to a pressure controlled inflatable pad apparatus, in particular, a pressure controlled alternating inflatable pressure pad apparatus.

Alternating pressure pads are well known for the prevention and management of decubitus ulcers in bedridden patients. The formation of decubitus ulcers, commonly known as bedsores, results from, amongst other things, the pressure applied to certain portions of the skin of a bedridden patient. In addition, it is well known that should the lower reflex arc be broken by, for instance, lesion of the spinal cord or of nerve roots then decubitus ulcers of unusual severity and rapidity of onset are likely to develop.

Alternating pressure pads generally comprise two sets of alternately inflatable cells; the duration of the inflation and deflation cycles may last from under two minutes for a gentle massaging effect to over twenty minutes. Huntleigh Technology plc manufacture and supply such an alternating pressure pad system.

A high air pressure in the pads may be needed to support the bony protuberances of a patient and to ensure that the patient is lifted sufficiently away from deflated cells of the pad so that adequate pressure relief is provided. A low air pressure, however, is desirable since it provides a pad which is softer and more comfortable. Optimal pressure support therefore not only varies from patient to patient but also during a given inflation cycle of the pad since the pressure supporting points will change during a cycle. The required optimal support pressure will vary even more as a patient changes from a supine to a sitting position.

It is known to provide a manually adjustable pressure controller to set an optimal pad support pressure. This may be a regulator for the compressor supplying air to the alternating pressure pad. It is also known to provide an automatic pressure controller comprising a convoluted compressible tube placed under the pad. In such a system, a small amount of air is diverted through the tube, the passage of air being detected by a pilot valve. When the support pressure in the pad is so inadequate that the pressure exerted by a patient causes the tube to be compressed shut, the pilot valve actuates a throttle which diverts a fixed proportion of air, such as one third, from the compressor to the pad thereby to increase the support pressure. When the tube is not closed, the fixed proportion of air is vented to the air via a relief valve. Such a system, however, is complex, costly and inefficient.

WO89/08438 (PCTGB 89/00232) in the name of Huntleigh Technology plc describes a pressure controller which has a means which is sensitive to fluid pressure which is adapted to open a valve when the predetermined pressure in an alternating pressure pad is reached. This pressure controller also comprises a sensor pad which is compressible in dependence upon a patient's weight distribution on the alternating pressure pad. If the patient is not suitably supported, the sensor pad will reduce the escape of fluid from the valve thereby ensuring that more fluid is supplied to the alternating pressure pad until the patient is supported as required.

This arrangement necessitated the use of four connecting tubes between the pump and the mattress and the use of a suitable means for sensing fluid pressure.

The applicants, therefore, sought to develop a pressure controller which achieved the same result with a simpler arrangement.

According to the present invention, there is provided a pressure controlled inflatable pad apparatus for supporting a body comprising an inflatable pad, a source of inflation fluid to provide a flow of said fluid to the pad for inflating the pad, a sensor, a fluid supply line and a connection for fluid flowing through the supply line to the pad and through the sensor to exhaust, the sensor being arranged when located beneath the pad to reduce fluid flow to exhaust if the pad is insufficiently inflated to support the body.

According to the present invention, there is also provided a pressure controlled inflatable pad apparatus for supporting a body comprising an inflatable pad, a source of inflation fluid to provide a flow of said fluid to the pad for inflating the pad, a sensor and a connection for fluid to flow during said inflating flow of fluid, from the interior of the pad through the sensor to exhaust, the sensor being arranged when located beneath the pad to reduce fluid flow to exhaust if the pad is insufficiently inflated to support the body.

Preferably, the inflatable pad is a pressure pad of alternately inflatable sets of cells.

In one embodiment, there are separate connections from each set of cells, each connection having a non-return valve and the connections being joined to form a single outlet to the sensor which has a single fluid flow reducing passage.

In another embodiment, there are separate connections from each set of cells and the sensor is provided with respective separate fluid flow reducing passages.

Preferably, a rotary valve is connected to the source of inflation fluid having an inlet and two outlets, each outlet being connected to one set of cells.

Preferably, the rotary valve can be stopped in a position such that each set of cells is inflated simultaneously as a static pressure pad.

Alternatively, the inflatable pad is a static pressure pad.

In a further aspect, the present invention provides an apparatus for supporting a body comprising an inflatable pad having a plurality of separately inflatable segments, a source of inflation fluid to provide a flow of said fluid to the segments to inflate the segments, a respective fluid supply line to each segment and a respective sensor for each segment of the pad, a respective connection for fluid flowing through each supply line to the respective segments to flow through the respective sensor to exhaust, each sensor being arranged when located beneath its respective segment of the pad to reduce fluid flow to exhaust if said segment is insufficiently inflated to support the body.

Preferably, each fluid supply line is provided with a flow restrictor to allow the separate segments to be inflated to different support pressures.

In one embodiment, each sensor is connected directly to the interior of its respective segment.

In another embodiment, each sensor is connected to the fluid supply line to its respective segment.

Preferably, each segment of the inflatable pad is a pressure pad of alternately inflatable sets of cells.

Alternatively, each segment of the inflatable pad is a static pressure pad.

Preferred embodiments of the present invention will now be described in detail, by way of example only, with reference to the accompanying drawings, of which:

Figure 1:
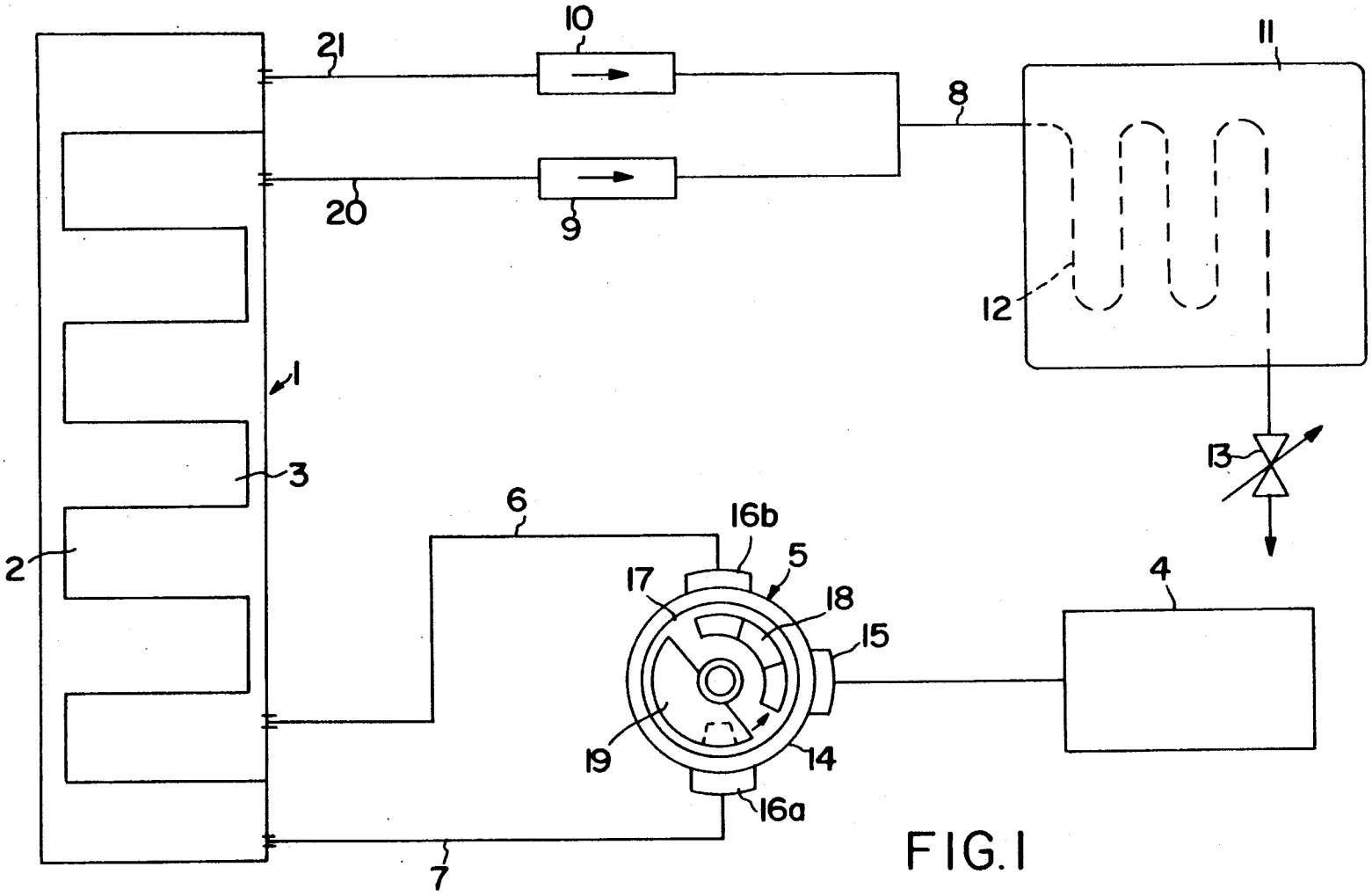
FIG. 1 is a schematic representation of a first preferred embodiment of the present invention.

FIG. 1 depicts an inflatable pad 1 which is alternating and comprises two sets of cells 2 and 3. Both sets of cells 2 and 3 are supplied with air from a pump or compressor 4 via a rotary valve 5. A pair of supply lines 6 and 7 lead from the rotary valve 5 to the pad 1—supply line 6 being connected to the set of cells 2 and supply line 7 being connected to the set of cells 3. A sensor pad 11 is connected directly to the interior of the pad 1 by connecting lines 20 and 21. Each of the connecting lines 20 and 21 has a non-return valve 9 and 10 respectively. The sensor pad 11 will be located beneath a patient or the body to be supported. In FIG. 1 the connecting lines 20 and 21 join to form a single output line 8 to the sensor pad 11. The sensor pad 11 comprises a single compressible tube 12 arranged in a convoluted path. Air passing through the sensor pad 11 is "blocked" by a relief valve 13 pre-set to a predetermined pressure which sets the minimum pressure to which cells 2 and 3 inflate. However, the relief valve 13 can be dispensed with if no minimum pressure value is necessary.

In use, the pump 4 will deliver air (or another inflation fluid) to the pad 1 via rotary valve 5 so that each set of cells 2 and 3 is alternately inflated. The inflation/deflation cycle may repeat over periods varying from two minutes to over twenty minutes. The rotary valve 5 operates so that during inflation of the set of cells 2, air from the set of cells 3, in addition to air from the pump 4 passes into set of cells 2. This is the "cross-over" point. Further, when, or preferably before, the pressure difference of the air in set of cells 3 over the air from the pump 4 becomes negligible, the air from set of cells 3 is prevented from passing in to set of cells 2. Similarly, during inflation of the other set of cells 3, the air from set of cells 2 is allowed to pass into set of cells 3 for an initial period.

The rotary valve 5 includes a stator 14 having an inlet 15 and outlets 16*a* and 16*b* and a rotor 17 which is motor driven. The inlet 15 of the stator is connected to pump 4 and the outlets 16*a* and 16*b* are connected to sets of cells 3 and 2 respectively. The rotor 17 is provided with a vent 18 and an inlet port 19. During one revolution of the rotor 17 within the stator 14, first one set of cells and then the other is connected to the pump 4. However, there is a point in the cycle when both sets of cells 2 and 3 are connected to each other via the rotor 17. This is the "cross-over point" and occurs when the rotor 17 is positioned with its inlet port 19 extending between outlets 16*a* and 16*b*. Deflation of the cells 2 and 3 is effected by a vent 18 in the rotor 17 which communicated alternately with outlets 16*a* and 16*b*.

The air leaving the interior of the pad 1 is only able to pass through the non-return valves 9 and 10 in connection lines 20 and 21 in one direction in order to prevent air leaking back through any deflated cells when the inflated cells are fully inflated. The air in lines 20 and 21 is combined to form a single outlet line 8 before passing into the compressible tube 12 in the sensor pad 11. If the weight of the patient is such that the compressible tube 12 is compressed even though the cells are inflated, the air exhausting to the atmosphere via relief valve 13 will be reduced and the air supplied from the pump 4 will continue to inflate the cells until the weight of the patient is no longer able to compress tube 12. Thus, air exhausted to the atmosphere now depends upon the compression of the sensor pad 11 and is a function of the weight distribution of the patient. Normal operation occurs when the pressure within the cells rises to the predetermined value and air can pass freely through the sensor pad because the alternating pressure pad is giving the required support to the patient.

It will be appreciated that the sensor could comprise separate compressible tubes 12 for air from each of the supply lines rather than using an outlet line 8 and a single compressible tube 12.

Clearly, this is a simple and efficient arrangement which requires only a small number of connecting tubes between the compressor and mattress.

The pressure controlled inflatable pad depicted in FIG. 1 could easily be adapted for use with a static pressure pad system in either of the following ways:

(a) The rotary valve 5 is omitted and the pump 4 is connected directly via supply lines 6 and 7 to the pad 1; or (b) The rotary valve 5 is retained but the rotor is stopped at the cross-over point so that the two sets of cells 2 and 3 in the pad 1 are connected in parallel making the arrangement operate as a static system.

Although the sensor pad 11 is shown connected via connection lines 20 and 21 to the opposite end of pad 1 to supply lines 6 and 7, it will be appreciated that the sensor pad 11 could be connected at any point on the pad 1 provided that it takes the air directly from the interior of the pad 1.

Figure 2:
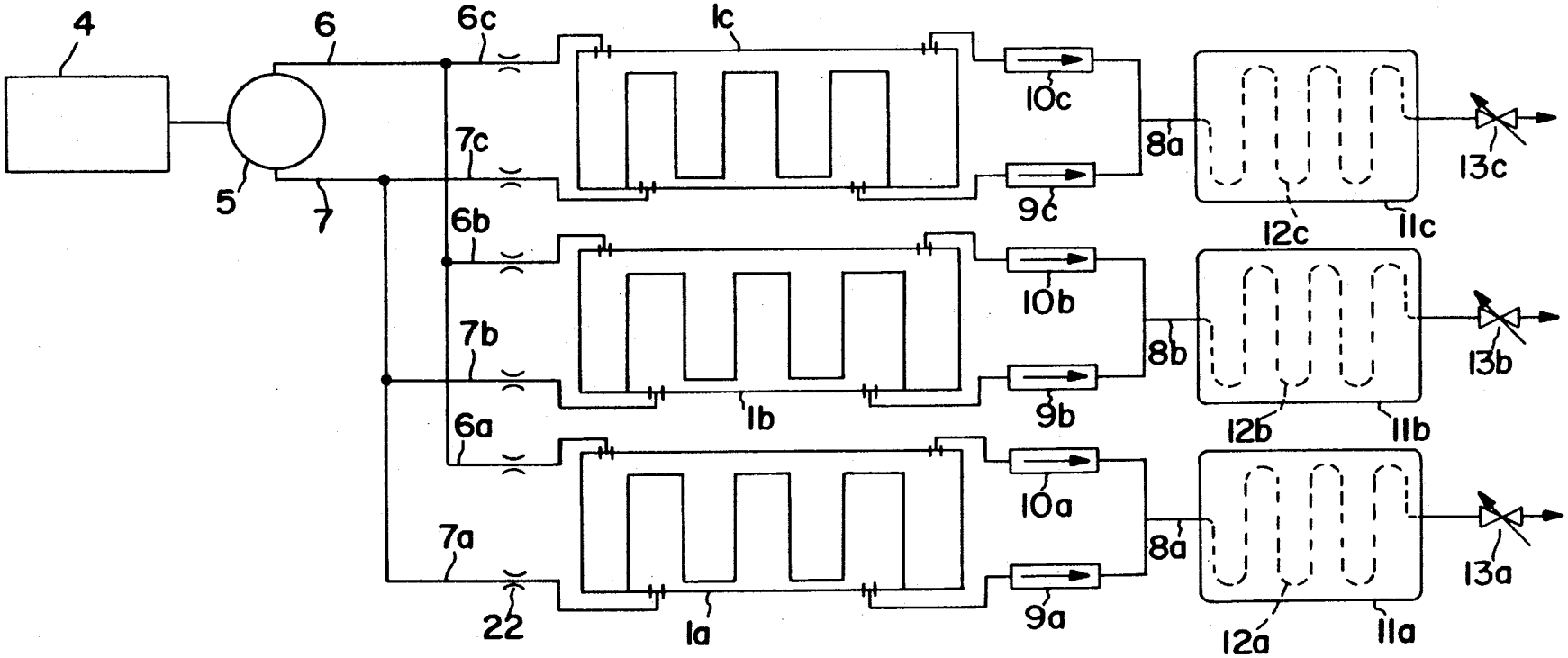
FIG. 2 is a schematic representation of a second preferred embodiment of the present invention.

FIG. 2 depicts a second preferred embodiment of the present invention where the pump 4 feeds a segmented pressure pad comprising three separate pressure pads 1*a*, 1*b* and 1*c*. In this figure like reference numerals represent like features to those in FIG. 1. As in FIG. 1, the pressure pads 1*a*, 1*b* and 1*c* are alternating pressure pads having sets of alternately inflatable cells. Each pressure pad 1*a*, 1*b* and 1*c*, has its own sensor pad 11*a*, 11*b* and 11*c*, respectively. In this arrangement, the sensor pads 11*a*, 11*b* and 11*c* are each connected directly to the interior of the pressure pads 1*a*, 1*b* and 1*c* via non-return valves in a similar manner to FIG. 1. Each of the supply lines 6*a*, 7*a*, 6*b*, 7*b* and 6*c*, 7*c*, is provided with a flow restrictor 22 which can be a region of reduced diameter of the tube or could be achieved alternatively by choosing appropriate lengths of a standard tube. In this way, there will be a pressure drop across the restrictor 22 depending on the flow rate through it which will allow the separate pads 1*a*, 1*b* and 1*c*, to be held at different pressures. Thus, the segmented pressure pad can provide areas of different support to a patient or other body placed upon it. For example, a mattress having such a segmented pressure pad could be adjusted so that the legs of the patient are not over-supported when the trunk of the patient is at an optimum support pressure. It should be noted that only a single pump 4 of adequate capacity is required to feed each separate segment which greatly simplifies the arrangement. Furthermore, there need only be two pipes connecting the pump to the mattress assembly.

Figure 3:
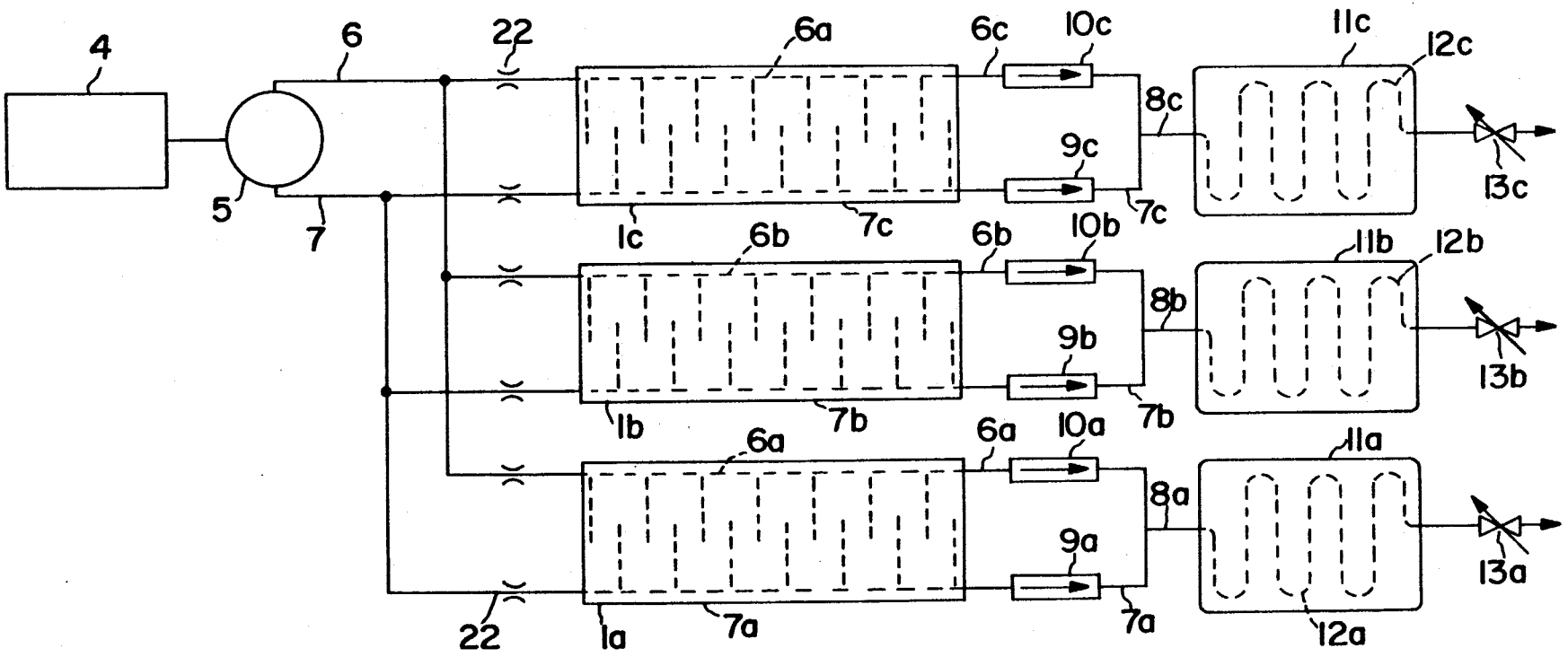
FIG. 3 is a schematic representation of a third preferred embodiment of the present invention.

FIG. 3 also depicts a segmented pressure pad but in this third embodiment the sensor pads 11*a*, 11*b* and 11*c* are connected to the supply lines 6*a*, 7*a*, 6*b*, 7*b* and 6*c*, 7*c*, which lead out from the pressure pads 1*a*, 1*b* and 1*c*.

As in FIGS. 1 and 2, the pressure pads 1*a*, 1*b* and 1*c*, comprise two sets of alternating cells.

It will be appreciated that both the embodiments in FIGS. 2 and 3 could easily be adapted for use with a static pressure pad arrangement as described earlier in connection with FIG. 1.

It is envisaged that the present invention could be utilised not only in the medical field in the form of a mattress but also in other fields where support of a body or object is to be finely adjusted.

I claim:

1. A pressure controlled inflatable pad apparatus for supporting a body comprising an inflatable pad, a source of inflating fluid to provide a flow of said fluid to the pad for inflating the pad, a sensor, a fluid supply line for fluid flowing through the supply line to the pad and then through the sensor to an exhaust, the sensor being located beneath the pad, said sensor serving to reduce fluid flow to said exhaust if the pad is insufficiently inflated to support the body.

2. A pressure controlled inflatable pad apparatus for supporting a body comprising an inflatable pad, a source of inflating fluid to provide a flow of said fluid to the pad for inflating the pad, a sensor and a connection for fluid to flow, during said inflating flow of fluid, from the interior of the pad through the sensor to an exhaust, the sensor being located beneath the pad, said sensor serving to reduce fluid flow to said exhaust if the pad is insufficiently inflated to support the body.

3. An apparatus as claimed in claim 1 or claim 2 wherein the inflatable pad is a pressure pad of alternately inflatable sets of cells.

4. An apparatus as claimed in claim 3 wherein there are separate connections from each set of cells, each connection having a non-return valve and the connections being joined to form a single outlet to the sensor which has a single fluid flow reducing passage.

5. An apparatus as claimed in claim 3 wherein there are separate connections from each set of cells and the sensor is provided with respective separate fluid flow reducing passages.

6. An apparatus as claimed in any of claims 3 further comprising a rotary valve connected to the source of inflation fluid having an inlet and two outlets, each outlet being connected to one set of cells.

7. An apparatus as claimed in claim 6 wherein the rotary valve can be stopped in a position such that each set of cells is inflated simultaneously as a static pressure pad.

8. An apparatus as claimed in claim 1 or claim 2 wherein the inflatable pad is a static pressure pad.

9. An apparatus as claimed in claim 4, further comprising a rotary valve connected to the source of inflation fluid having an inlet and two outlets, each said outlet being connected to one set of cells.

10. An apparatus as claimed in claim 9 wherein the rotary valve can be stopped in a position such that each set of cells is inflated simultaneously as a static pressure pad.

11. An apparatus as claimed in claim 5, further comprising a rotary valve connected to the source of inflation fluid having an inlet and two outlets, each said outlet being connected to one set of cells.

12. An apparatus as claimed in claim 11 wherein the rotary valve can be stopped in a position such that each set of cells is inflated simultaneously as a static pressure pad.

13. A pressure controlled inflatable pad apparatus for supporting a body comprising an inflatable pad having a plurality of separately inflatable segments, a source of inflation fluid to provide a flow of said fluid to the segments to inflate the segments, a respective fluid supply line to each segment and a respective sensor for each segment of the page, a respective connection for fluid flowing through each supply line to the respective segments to flow through the respective sensor to an exhaust, each sensor being located beneath its respective segment of the page, each said sensor serving to reduce fluid flow to said exhaust if said segment is insufficiently inflated to support the body.

14. An apparatus as claimed in claim 13 wherein each fluid supply line is provided with a flow restrictor to allow the separate segments to be inflated to different support pressures.

15. An apparatus as claimed in claim 13 or claim 14 wherein each sensor is connected directly to the interior of its respective segment.

16. An apparatus as claimed in claim 13 or claim 14 wherein each sensor is connected to the fluid supply line to its respective segment.

17. An apparatus as claimed in any of claims 13 or 14 wherein each segment of the inflatable pad is a pressure pad of alternately inflatable sets of cells.

18. An apparatus as claimed in any of claims 13 or 14 wherein each segment of the inflatable pad is a static pressure pad.

19. An apparatus as in claim 15 wherein each segment of the inflatable pad is a pressure pad of alternately inflatable sets of cells.

20. An apparatus as in claim 16 wherein each segment of the inflatable pad is a pressure pad of alternately inflatable sets of cells.

21. An apparatus as in claim 15 wherein each segment of the inflatable pad is a static pressure pad.

22. An apparatus as in claim 16 wherein each segment of the inflatable pad is a static pressure pad.

* * * * *

UNITED STATES PATENT AND TRADEMARK OFFICE

CERTIFICATE OF CORRECTION

PATENT NO. : 5,189,742

DATED : March 2, 1993

INVENTOR(S) : Rolf Schild

It is certified that error appears in the above-identified patent and that said Letters Patent is hereby corrected as shown below:

On the title page: Item [73] Assignee

Assignee should read -- Huntleigh Technology, Luton, United Kingdom --.

Column 5, line 43, "any of claims" should read --claim--.

Column 6, line 21, "page," should read --pad,--.
line 25, "page," should read --pad, --.

Signed and Sealed this

Twenty-second Day of June, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT : 5,189,742

DATED : March 2, 1993

INVENTOR(S) : Rolf Schild

It is certified that error appears in the above-identified patent and that said Letters Patent is hereby corrected as shown below:

On the title page, item [73], the Assignee should read:
--Huntleigh Technology PLC, Bedfordshire, United Kingdom--.
Column 5, line 43, "any of claims" should read --claim--.
Column 6, line 21, "page," should read --pad,--.
Column 6, line 25, "page," should read --pad,--.

This certificate supersedes Certificate of Correction issued June 22, 1993.

Signed and Sealed this
Eighteenth Day of November 1997

*Attest:*

Bruce Lehman

BRUCE LEHMAN

*Attesting Officer*

*Commissioner of Patents and Trademarks*